US008746542B2

(12) United States Patent
Hallam

(10) Patent No.: US 8,746,542 B2
(45) Date of Patent: Jun. 10, 2014

(54) CARTONS, TO METHODS OF CONSTRUCTING THE SAME AND TO CARTON BLANKS THEREFOR

(75) Inventor: Chris Hallam, Bradford (GB)

(73) Assignee: Concept Packaging Services Limited, Bradford (GB)

( * ) Notice: Subject to any disclaimer, the term of this patent is extended or adjusted under 35 U.S.C. 154(b) by 557 days.

(21) Appl. No.: 12/670,255

(22) PCT Filed: Jul. 22, 2008

(86) PCT No.: PCT/GB2008/050614

§ 371 (c)(1),
(2), (4) Date: May 12, 2010

(87) PCT Pub. No.: WO2009/013542

PCT Pub. Date: Jan. 29, 2009

(65) Prior Publication Data

US 2010/0294831 A1 Nov. 25, 2010

(30) Foreign Application Priority Data

Jul. 25, 2007 (GB) ..... 0714495.9

(51) Int. Cl.
*B65D 3/22* (2006.01)

(52) U.S. Cl.
USPC ..... 229/122.34; 229/122.32

(58) Field of Classification Search
USPC ..... 229/141, 122.34; 493/52
See application file for complete search history.

(56) References Cited

U.S. PATENT DOCUMENTS

| | | | | | |
|---|---|---|---|---|---|
| 1,755,694 | A | * | 4/1930 | Keppler | 229/175 |
| 1,833,599 | A | | 11/1931 | Stroehmann | |
| 1,970,582 | A | | 8/1934 | Snyder et al. | |
| 2,143,308 | A | * | 1/1939 | Flach | 229/175 |
| 2,217,504 | A | * | 10/1940 | Bergstein | 493/132 |
| 2,836,338 | A | | 5/1958 | Daniels | |
| 2,965,279 | A | * | 12/1960 | Campbell | 206/509 |
| 3,286,900 | A | | 11/1966 | Keith | |
| 2006/0163334 | A1 | | 7/2006 | Kay | |

FOREIGN PATENT DOCUMENTS

| | | |
|---|---|---|
| FR | 79977 | 2/1963 |
| FR | 2579175 | 9/1986 |
| GB | 2283008 | 4/1995 |
| WO | 2006097683 | 9/2006 |

* cited by examiner

*Primary Examiner* — Gary Elkins
*Assistant Examiner* — Christopher Demeree
(74) *Attorney, Agent, or Firm* — Trego, Hines & Ladenheim, PLLC

(57) ABSTRACT

A carton comprising an inner layer (100) and an outer layer (2), the inner layer comprises at least one side wall, which inner side wall comprises at least two layers (116, 118) of carton material in a face to face relationship with one another and the outer layer comprises a base portion (4) and at least one side wall (14, 22) about the inner layer side wall.

9 Claims, 7 Drawing Sheets

CARTONS, TO METHODS OF CONSTRUCTING THE SAME AND TO CARTON BLANKS THEREFOR

FIELD OF THE INVENTION

The present invention relates to cartons, to methods of constructing the same and to carton blanks therefor.

BACKGROUND TO THE INVENTION

It is known that rigid boxes can be produced, primarily for use as lids or bases with another construction, by placing a carton board outer layer around a thicker inner layer, which is usually corrugated card, to create a strong box, with thick, chunky wall sections.

Such constructions suffer from a number of weaknesses, including:

Weak corners;

The step of folding the outer layer about the inner layer is very labour intensive, especially the close parallel creases at the top of the side walls; and The webbed corner material used in this construction for the outer layer is often visible and unsightly.

WO-A-2006/097683 discloses a construction for a rectangular padded box comprising an inner board layer and an outer board layer, the inner layer comprising a rectangular base and a wall upstanding from each edge of the base, the outer layer having a rectangular base and walls upstanding from each edge of the rectangular base of the outer layer to sandwich the inner layer upstanding walls.

It is an aim of preferred embodiments of the present invention to provide a carton, a method of constructing the same and a carton blank therefor that overcomes or obviates a disadvantage of the prior art, whether such prior art or disadvantage is referred to herein or otherwise.

SUMMARY OF THE INVENTION

According to the present invention in a first aspect, there is provided a carton comprising an inner layer and an outer layer, the inner layer comprises at least one side wall, which inner side wall comprises at least two layers of carton material in a face to face relationship with one another and the outer layer comprises a base portion and at least one side wall about the inner layer side wall.

Suitably, the two layers forming the inner side wall are in face to face contact.

Suitably, the carton is adhesive-free.

Optionally, the at least two layers are affixed together. Suitably, the at least two layers are affixed together by an adhesive.

Suitably, the inner layer comprises a base portion to which the inner layer side wall is attached. Suitably, the base portion comprises a plurality of edges and an inner layer side wall extends from at least two edges of the base portion. Suitably, an inner layer side wall extends from each edge of the base portion.

Suitably, a second inner layer side wall extends from a first end of a first inner layer side wall.

Suitably, a third inner layer side wall extends from a second end of the first inner layer side wall.

Suitably, a third inner layer side wall is attached to a base portion of the inner layer.

Suitably, the inner layer comprises at least one upstanding corner provided by a hinged connection between a first inner side wall and a second inner side wall.

Suitably, a third inner layer side wall comprises a first wall part extending from and hingedly connected to a first inner layer side wall and a second wall part extending from and hingedly connected to a second inner layer side wall, which first wall part and second wall part cooperate to form the third inner layer side wall.

Suitably, the base portion is four-sided and a first inner layer side wall is connected to one edge only of the base portion. Suitably, inner side walls for the other edges are provided in one or more strips extending from the first inner layer side wall. Suitably, a second inner layer side wall extends from and is hingedly connected to the first inner layer side wall at a first end thereof. Suitably, a third inner layer side wall extends from and is hingedly connected to the first inner layer side wall at a second end thereof. Suitably, a fourth inner layer side wall comprises a first wall part extending from and hingedly connected to the second inner layer side wall and a second wall part extending from and hingedly connected to the third inner layer side wall, which first wall part and second wall part cooperate to form the fourth inner layer side wall.

Suitably, the first wall part is affixed to the second wall part.

Suitably, the first wall part and the second wall part comprise interlocking means for interlocking with one another. Suitably, the first wall part comprises a male member and the second wall part comprises a female member, in which the male member is adapted to interlock with the female member.

Suitably, the outer layer comprises webbed corner constructions and the inner layer comprises cut-away sections for accommodating at least part of the webbed corner constructions.

Suitably, the inner layer side wall comprises securing means for securing the outer layer relative to the inner layer. Suitably, the securing means comprise slots in the inner layer for receiving tabs on the outer layer.

Suitably, an inner layer side wall comprises a first wall layer hingedly connected to a second wall layer. Suitably, the first wall layer is hinged to the second wall layer by a perforation. More suitably, the first wall layer is hinged to the second wall layer by a score line.

According to the present invention in a second aspect there is provided a method of construction of a carton, the carton comprising an inner layer and an outer layer, the inner layer comprises at least one side wall, which inner side wall comprises at least two layers of carton material in a face-to-face, in-contact relationship to one another and the outer layer comprises a base portion and at least one side wall, the method comprising the step of folding the outer layer side wall around the inner layer side wall.

Suitably, the carton is according to the first aspect of the present invention.

According to the present invention in a third aspect, there is provided an inner layer for a carton, the inner layer comprising a base portion and a side wall, the side wall having at least two interengaging ends.

Suitably, the inner layer is configured to form a carton according to the first embodiment of the present invention.

According to the present invention in a fourth aspect, there is provided a method of construction of an inner layer for a carton, the inner layer comprising a base portion and a side wall, the side wall having at least two interengaging ends, in which the method comprises interengaging the interengaging ends.

According to the present invention in a fifth aspect, there is provided an inner layer for a carton, the inner layer comprising at least two adjacent hingedly connected side walls.

The inner layer may form a carton according to the first embodiment of the present invention.

According to the present invention in a third aspect, there is provided a carton blank or carton blanks for a carton according to the first aspect of the invention.

BRIEF DESCRIPTION OF THE DRAWINGS

For a better understanding of the invention, and to show how embodiments of the same may be carried into effect, reference will now be made, by way of example, to the accompanying diagrammatic drawings in which.

DESCRIPTION OF THE PREFERRED EMBODIMENTS

Figure 1:
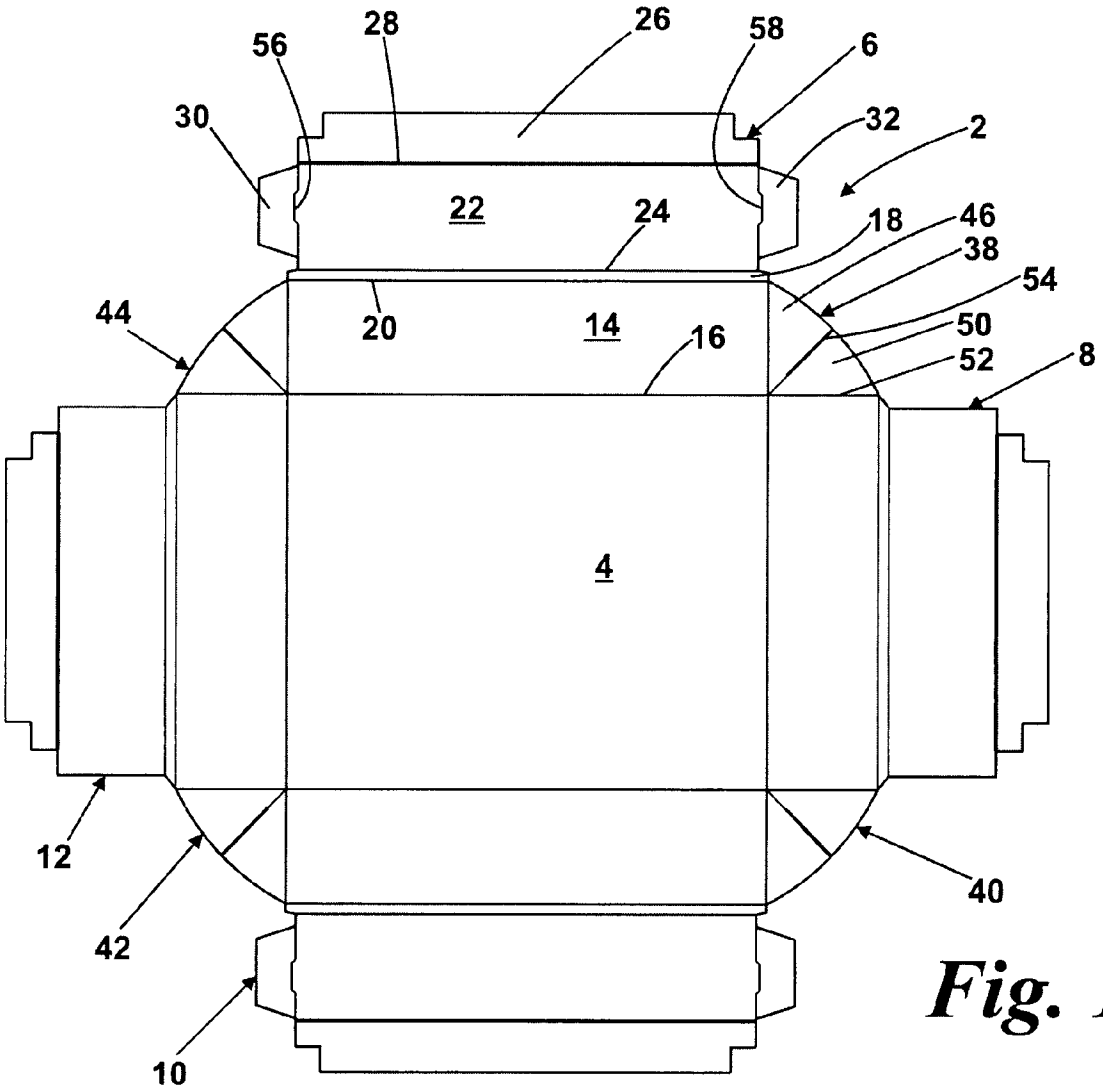
FIG. 1 is a plan view of a carton blank for an outer layer of a carton according to an embodiment of the present invention.

Referring to FIG. 1 of the accompanying drawings, there is shown an outer layer blank 2 for a carton according to the present invention. The material of the bank 2 is solid board. The outer layer blank 2 comprises a rectangular base portion 4 and four outer layer side wall constructions 6, 8, 10 and 12, respectively, one extending from each edge of the base portion. Each of the opposing outer layer side wall constructions 6, 8 and 10, 12 is equivalent, so only one of each will be described in detail. Outer layer side wall construction 6 comprises an outer upstanding wall panel 14 hingedly connected by a crease line 16 to an edge of base portion 4. The outer upstanding wall panel 14 is hingedly connected to a spacer panel 18 by a crease line 20, which spacer panel 18 is hingedly connected to an inner upstanding wall panel 22 by a crease line 24. Inner upstanding wall panel 22 is hingedly connected to a locking panel 26 by a cut/crease line 28. Extending from each end of inner upstanding wall panel 22 are flaps 30, 32 respectively hingedly connected to inner upstanding wall panel 22 by crease lines 34, 36, respectively.

Outer layer side wall construction 10 is substantially identical to outer layer side wall construction 6.

Outer layer side wall construction 8 is similar to outer layer side wall construction 6 except that it does not include flaps corresponding to flaps 30, 32.

Between each of the outer layer side wall constructions 6, 8, 10 and 12, between the respective outer upstanding wall panel, identified by reference numeral 14 for outer layer side wall construction 6, is a web 38, 40, 42 and 44, respectively. Each web is substantially similar so only web 38 between outer layer side wall constructions 6 and 8 will be described in detail. The web 38 comprises a first web panel 46 hingedly connected to outer upstanding wall panel 14 by a crease line 48 and a second web panel 50 hingedly connected to the corresponding outer upstanding wall panel on the outer layer side wall construction 8 by a crease line 52. The first and second web panels 46, 50 are hingedly connected to each other by a crease line 54 extending at approximately 45° from the ends of the outer upstanding wall panels to which it is attached.

Inner upstanding wall panel 22 includes tabs 56, 58 cut from flaps 30, 32, respectively.

It is noted that the blank 2 shown in FIG. 1 is in its flat state and that references to "inner", "outer" and "upstanding" are applicable only when the carton is constructed.

Figure 2:
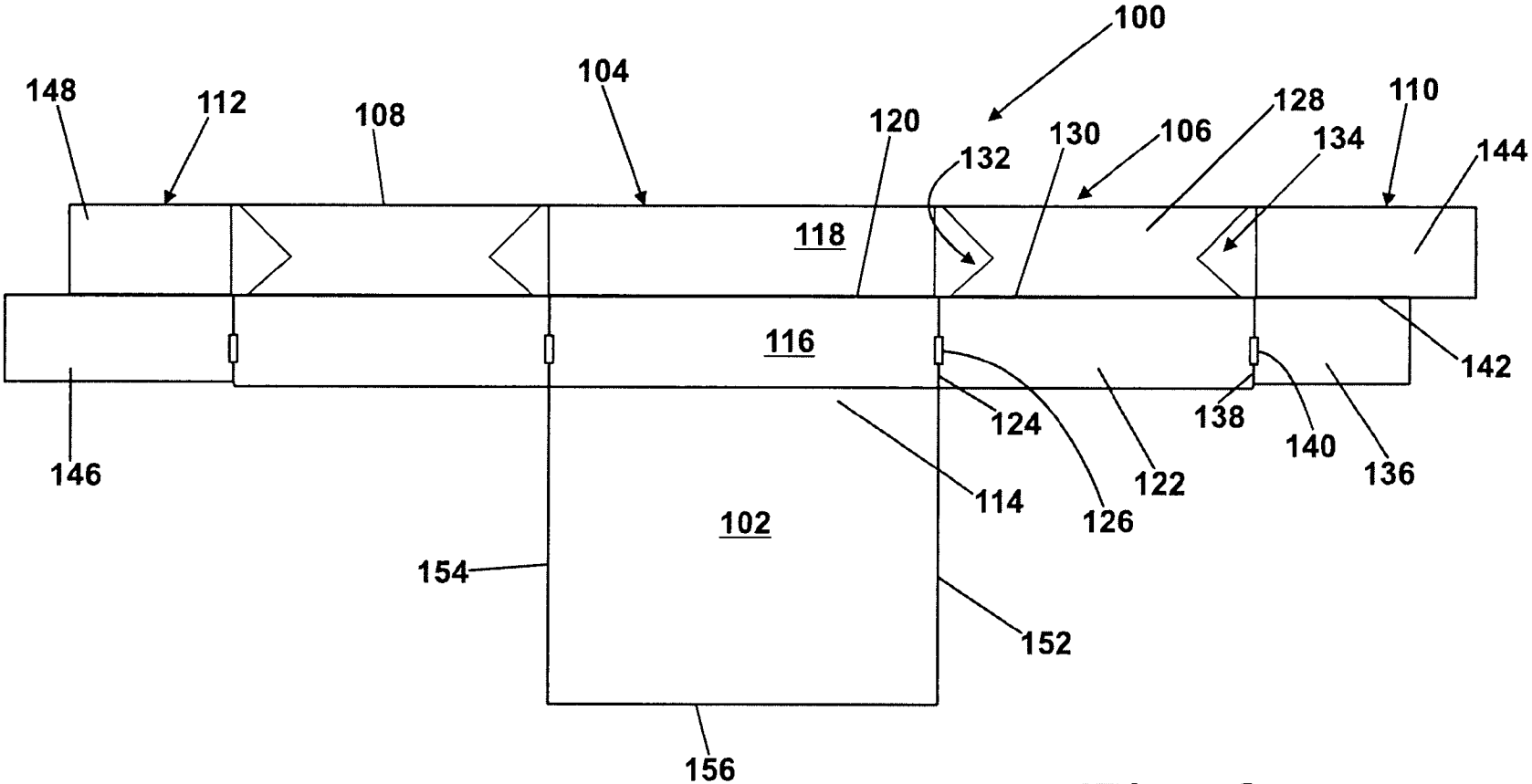
FIG. 2 is a plan view of a carton blank for an inner layer of a carton according to a first embodiment of the present invention for use with the outer layer shown in FIG. 1.

Referring to FIG. 2 of the accompanying drawings, there is shown an inner layer blank 100 according to a first embodiment of the present invention. The material of the inner layer blank 2 is carton board, which it is noted is significantly more rigid and incompressible than corrugated card.

Inner layer blank 100 comprises a rectangular base portion 102 and five inner layer side wall constructions 104, 106, 108, 110 and 112. Inner layer side wall construction 104 is hingedly connected to one edge of base portion 102 by a perforation line 114 and comprises a an inner upstanding side wall 116 connected to base portion 102 and also hingedly connected to outer upstanding side wall 118 by a score line 120.

Base portion 102 includes free edges 150, 152 and 154.

Inner upstanding side wall 116 is connected to one side to an inner upstanding side wall 122 of side wall construction 106 by a hinged connection formed by a perforation 124 which is interrupted by a locking slot 126. Inner upstanding side wall 122 is hingedly connected to an outer upstanding side wall 128 by a score line 130. The otherwise rectangular shape of outer upstanding side wall 128 is interrupted at either end by V-shaped cut-outs 132, 134, respectively.

Inner layer side wall construction 108 is substantially similar to that of inner layer side wall construction 106 except that it extends from the opposite end of inner upstanding side wall 116 and so will not be described further.

Inner layer side wall construction 110 comprises a partial upstanding side wall 136 hingedly connected to the end of inner upstanding side wall 122 opposite perforation line 124 by a perforation line 138, which is interrupted by a locking slot 140. Hingedly connected to partial upstanding side wall 136 by a score line 142 is an outer partial upstanding side wall 144. It is noted that outer partial upstanding side wall 144 is longer than partial upstanding inner side wall 136.

Inner layer side wall construction 112 is largely similar to that of inner layer side wall construction 110 except that in this case a partial upstanding inner side wall 146 is longer than a partial outer upstanding side wall 148.

It is noted that the blank 102 shown in FIG. 2 is in its flat state and that references to "inner", "outer" and "upstanding" are applicable only when the carton is constructed.

The material of the outer layer is thinner than the material of the inner layer.

In order to construct the inner and outer layer blanks 2, 100 into a carton according to an embodiment of the present invention the inner layer is assembled and the outer layer is assembled around that.

In more detail, outer partial upstanding side wall 144 is folded about score line 142 to be in face to face and in contact relationship with inner partial side wall 136. The same is carried out for inner layer side wall construction 112.

The inner layer side wall construction 104 is hinged about perforation 114 to approximately 90° relative to the base portion 102.

The inner layer side wall construction 106 is folded about perforation 124 so that inner upstanding side wall 122 butts against edge 152 of base portion 102. The same is carried out for inner layer side wall construction 108 so that it butts against edge 154 of base portion 102. Inner layer side wall construction 110 is folded about perforation 138 so that inner partial side wall 136 butts against edge 156 of base portion 102. The same is carried out for inner layer side wall construction 112 so that partial upstanding inner side wall 146 butts against edge 156 of base portion 102.

The different lengths of outer partial upstanding side wall 144 compared with partial outer upstanding side wall 148 and of partial upstanding side wall 136 compared with partial upstanding inner side wall 146 mean that there are overlapping tabs with butting ends forming a lap joint to enable the wall constructions 110 and 112 to combine to form a wall along edge 156 of base portion 102 with an easy locator for the wall assembly. The overlaps can be secured to together for instance by gluing or taping but this is not necessary given the outer sandwiches the inner.

One of the tabs 56 and 58 on the outer layer engage with slots 126 of the inner layer. The other tab 58 or 56 engages with another slot on the inner layer.

Optionally, before being folded over the outer upstanding side wall 128 has adhesive applied to it and is folded into a face to face, in contact relationship with inner upstanding side wall 122 to affix the two of them together. The same can be carried out for inner layer side wall construction 108. Outer partial upstanding side wall 144 can have an adhesive applied to it.

Figure 3:
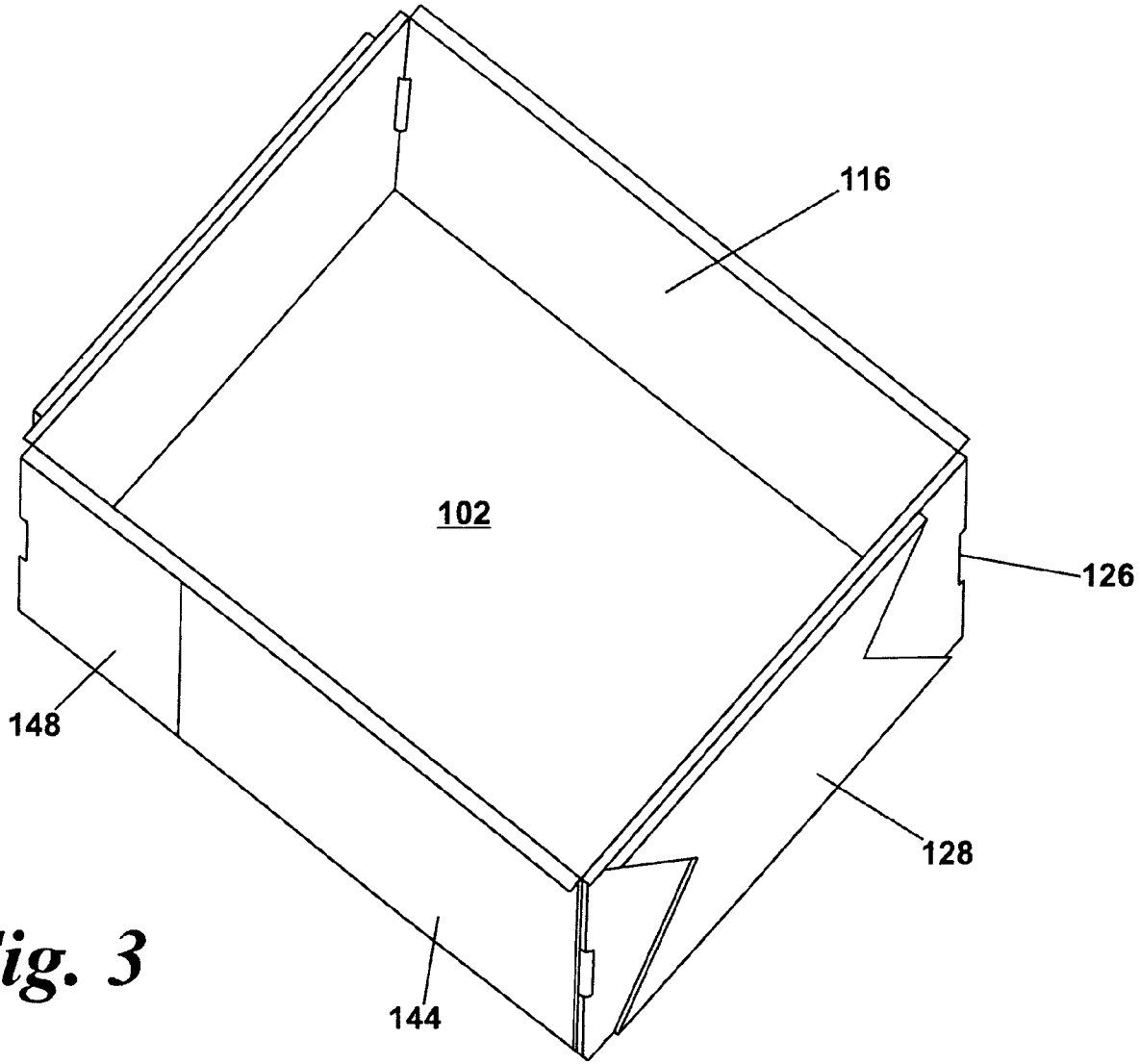
FIG. 3 is a schematic isometric view of the blank of FIG. 2 assembled.

Thus there is at this stage produced an open topped box as shown in FIG. 3 of the accompanying drawings.

The inner layer is then placed on the outer layer with the base portion 102 over and aligned with the base portion 4. The outer layer side walls are then assembled about the inner layer side walls.

Outer side wall 14 hinged about crease line 16 to about 90° relative to base portion 4. Outer upstanding side wall 22 is then folded over to lie in a face to face relationship with wall 116 of the inner layer. The spacer panel 18 lies on top of the inner wall over the double thickness of the board from which the side walls of the inner layer are made. Locking panel 26 lies on base portion 102. The same is carried out for outer layer side wall construction 10 and then for each of outer layer side wall constructions 8 and 12 so that these overlie flaps 30 and 32.

Optionally, first web panel 46 is adhered to outer wall 14. Corresponding single panels are adhered to adjacent panels, with web 44 also being adhered to outer wall 14, while webs 40 and 42 are both adhered to outer side wall construction 10, to the panel corresponding to outer wall 14 on construction 10.

Figure 4:
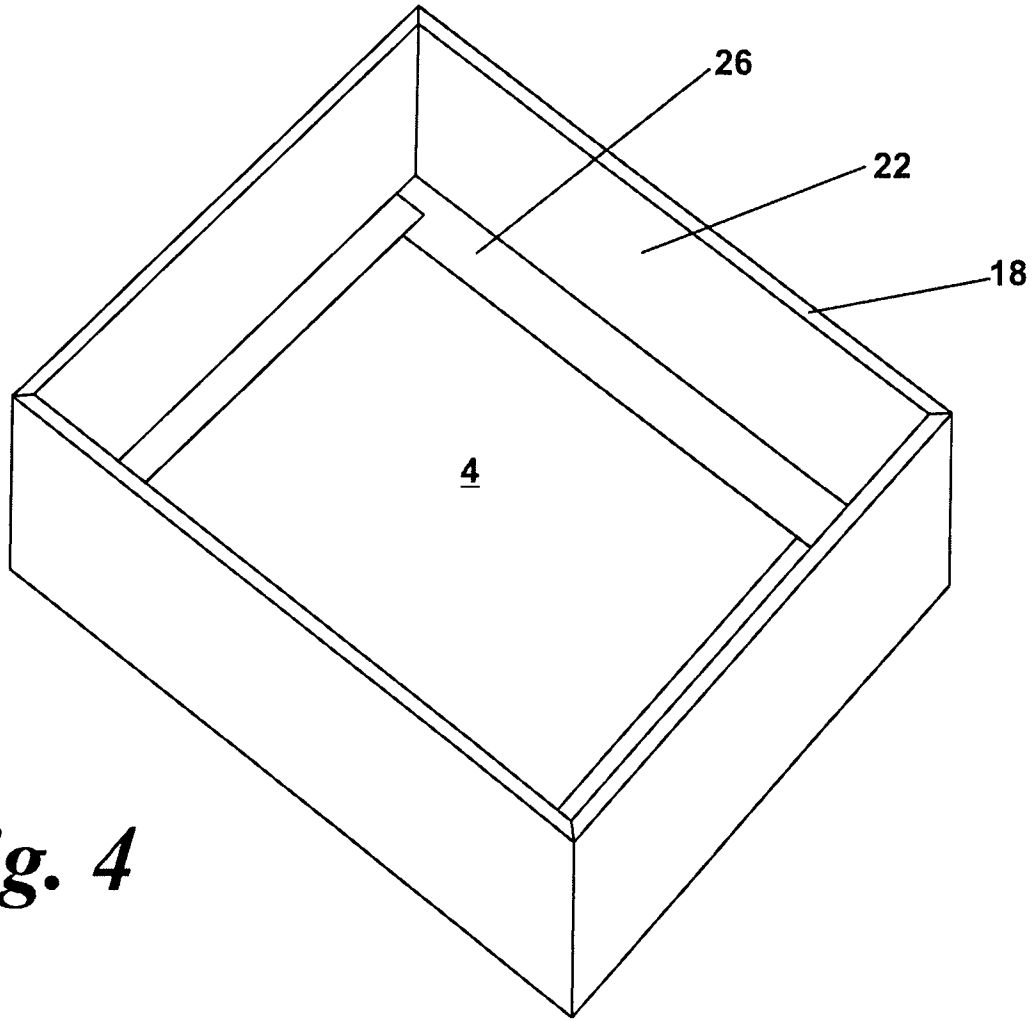
FIG. 4 is a schematic isometric view of a carton constructed from the assembled inner and outer blanks shown in FIGS. 1-3.

Referring to FIG. 4 of the accompanying drawings, there is shown a constructed carton 200 comprising the inner layer within the outer layer.

Figure 5:
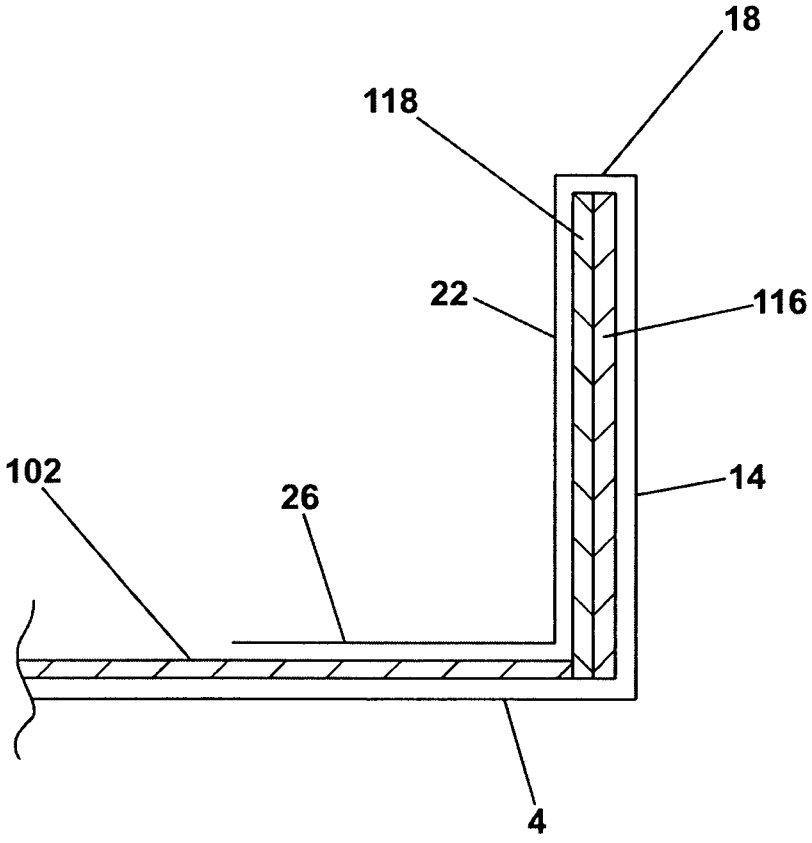
FIG. 5 is a cross sectional elevation of a side wall of the carton shown in FIG. 4.

Referring to FIG. 5 of the accompanying drawings, a cross-section of the assembled side wall of the carton is shown. It is noted that because the inner side wall comprises a plurality of layers, additional thickness can be provided and the top of the inner side wall, indicated by arrow 300 is formed preferably from a score line so the corners of the top of the side wall provide a stiff former about which the outer layer can be folded so that the spacer panel 18 can be folded neatly over the inner side wall. This reduces the labour intensiveness of the folding of the outer layer about the inner layer, especially the close parallel crease formed by spacer panel 18. It is noted that spacing between the inner and outer layers are exaggerated in FIG. 5 for clarity.

The corners of the assembled carton are stronger because they are formed from side walls hingedly connected to each other; that is they are connected to an adjacent wall.

Additionally because the band of the side wall is secured end-to-end by the tabs or interlocking means this provides additional corner strength.

The V-shaped cut out portions (132 and 134 in FIG. 2) provide a gap to accommodate the webs 40, 42, 44 and 46 to avoid unsightly bulges in the outer layer.

Figure 6:
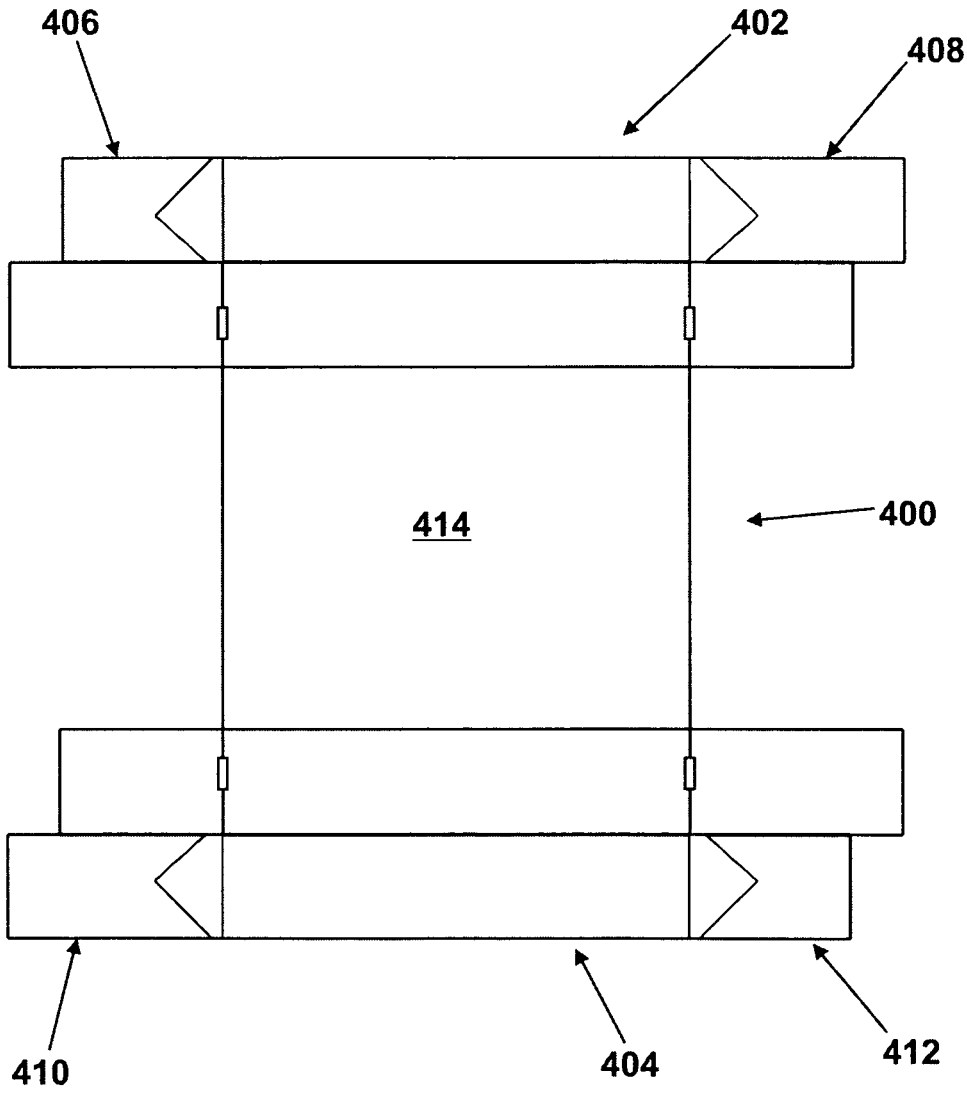
FIG. 6 is a plan view of a carton blank for an inner layer of a carton according to a second embodiment of the present invention for use with the outer layer shown in FIG. 1.

Referring to FIG. 6 of the accompanying drawings, there is shown an inner layer blank 400 according to a second embodiment of the present invention. The inner layer 400 can be used with the outer layer blank 2 described above. The inner layer blank 400 comprises inner side wall constructions 402, 404, 406, 408, 410 and 412. It will be apparent that the inner side wall constructions 402 and 404 are similar to inner side wall construction 104 shown in FIG. 2. Inner side wall constructions 402 and 404 are hingedly connected to a base portion 414. Inner side wall constructions 406 and 408 are hingedly connected to opposite ends of inner side wall construction 402. Inner side wall constructions 410 and 412 are hingedly connected to inner side wall construction 404. Inner side wall constructions 406 and 410 combine to form an inner side wall as do inner side wall constructions 408 and 412, with lap joints forming connections between inner side wall constructions 406/410 and 408/412. This construction has the advantage that two inner side walls are hingedly connected to the base portion 414 and the length of board is reduced minimising wastage and breakages.

Figure 7:
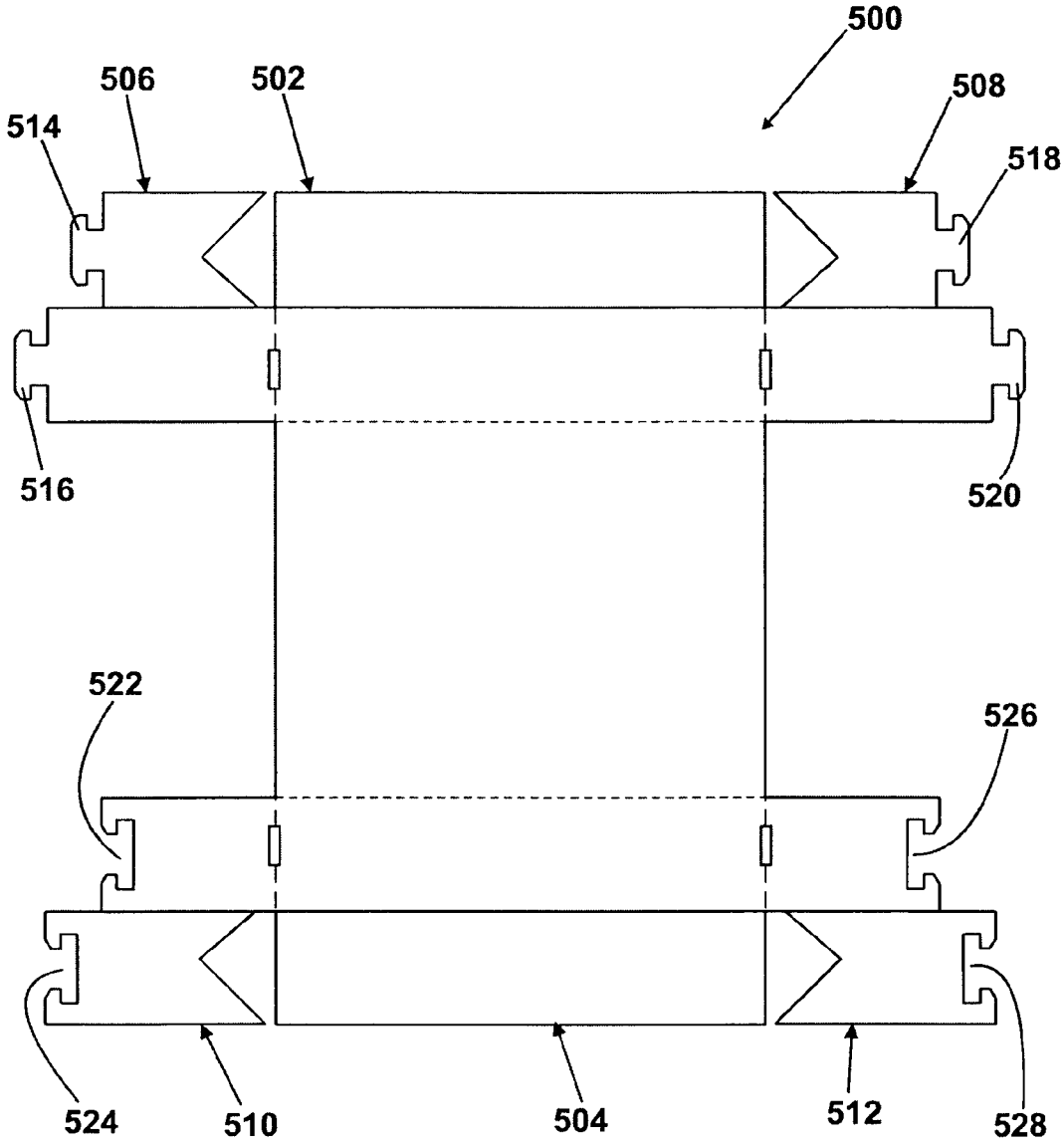
FIG. 7 is a plan view of a carton blank for an inner layer of a carton according to a third embodiment of the present invention for use with the outer layer shown in FIG. 1.

Referring to FIG. 7 of the drawings that follow, there is shown a third embodiment of an inner layer blank 500 according to the present invention. The blank 500 is similar to that shown in FIG. 6 and comprises inner side wall constructions 502, 504, 506, 508, 510 and 512 which correspond to the inner side wall constructions 402, 404, 406, 408, 410 and 412 shown in FIG. 6 and are constructed in a similar fashion. However, in the embodiment of FIG. 7, the inner side wall constructions 506 and 508 include T-shaped portions 514, 516, 518 and 520 and inner side wall constructions 510 and 512 comprise corresponding T-shaped slots 522, 524, 526 and 528. The T-shaped portions 514, 516, 58 and 520 comprise male interlocking means for interlocking with the T-shaped slots 522, 524, 526 and 528 comprising corresponding female interlocking means. When the inner layer blank 500 is assembled, the T-shaped portion 514 engages with T-shaped slot 524, T-shaped portion 516 engages with T-shaped slot 522, T-shaped portion 518 engages with T-shaped slot 528 and T-shaped portion 520 engages with T-shaped slot 526. This provides an alternative construction for locating the wall parts relative to each other and additional strength of connection. In this construction it is even less necessary to use an adhesive or tape to secure the part walls, simplifying the manufacturing process further, but such affixing means can be used if desired or necessary.

Thus, an adhesive-free construction can be achieved.

Preferred embodiments of the present invention provide a paper-free rigid box.

The constructed carton therefore can be used as a lid, a base or both.

Other modifications to the embodiments described herein can be made within the scope of the present invention. For instance, between the base portion 4 of the outer layer and the base portion 102, 414 of the inner layer a padding material can be provided to generate a curve on the outside of the carton. For manufacturing simplicity, the outer layer blank 2 and the inner layer blank may be provided as a single connected blank with a frangible connection that can be broken by the assembler of the carton initially.

Although in the described embodiments of the present invention, it has been stated that some lines are formed by scores and some by perforations, it will be appreciated that the choice of scores, perforations, cuts and/or creases is a design choice depending on the specific requirements. Just because a specific line is shown as a score, perforation, cut or crease does not limit the invention thereto.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A carton comprising an inner layer and an outer layer, the inner layer comprises a rectangular base portion and five inner layer side wall constructions, a first inner layer side wall construction is hingedly connected to one edge of the base portion and comprises a first inner upstanding side wall connected to the base portion and also hingedly connected to an outer upstanding side wall, the first inner upstanding side wall is connected to one side to a second inner upstanding side wall of the side wall construction by a hinged connection which is interrupted by a locking slot, third inner upstanding side wall is hingedly connected to a second outer upstanding side wall, an outer upstanding side wall comprises at either end V-shaped cut-outs, respectively;

a second inner layer side wall construction substantially similar to that of the first inner layer side wall construction except that it extends from the opposite end of first inner upstanding side wall;

a third inner layer side wall construction comprises a partial upstanding side wall hingedly connected to the end of the third inner upstanding side wall, which is interrupted by a locking slot; hingedly connected to the partial upstanding side wall is an outer partial upstanding side wall which is longer than partial upstanding inner side wall;

a fifth inner layer side wall construction similar to that of inner layer side wall construction except that a partial upstanding inner side wall is longer than a partial outer upstanding side wall;

which inner side wall comprises at least two layers of carton material in a face to face relationship with one another;

and the outer layer comprises a base portion and four outer layer side wall constructions, respectively, each outer layer side wall construction comprises an outer upstanding wall panel hingedly connected to an edge of base portion, the outer upstanding wall panel is hingedly connected to a spacer panel, which spacer panel is hingedly connected to an inner upstanding wall panel, inner upstanding wall panel is hingedly connected to a locking panel, extending from each end of inner upstanding wall panel for two opposed outer layer side wall constructions are flaps respectively hingedly connected to inner upstanding wall panel;

between each of the outer layer side wall constructions, between the respective outer upstanding wall panel, is a web, respectively, each web comprises a first web panel hingedly connected to outer upstanding wall panel and a second web panel hingedly connected to the corresponding outer upstanding wall panel on the outer layer side wall construction, the first and second web panels being hingedly connected to each other by a crease line extending at approximately 45° from the ends of the outer upstanding wall panels to which it is attached;

wherein inner upstanding wall panel includes tabs cut from flaps respectively;

and at least one side wall about the inner layer side wall.

2. A carton as claimed in claim 1, wherein the two layers forming the inner side wall are in face to face contact.

3. A carton as claimed in claim 1, wherein the carton is adhesive-free.

4. A carton comprising an inner layer and an outer layer, the inner layer comprises:

a rectangular base portion from opposed edges of which extend a first inner layer side wall construction and a second inner layer side wall construction both hingedly connected to the base portion, the first inner layer side wall construction comprising a first wall hingedly connected to the base portion and oppositely to a second wall, the first wall having flaps extending from and hingedly connected at either end thereof with locking slots between the flaps and the first wall, the second wall having flaps extending from and hingedly connected at either end thereof with a V-shaped cut-out portion between the flaps and the second wall; the second inner layer wall construction being similar and configured to form walls mating along the free edges of the base portion;

and the outer layer comprises a base portion and four outer layer side wall constructions, respectively, each outer layer side wall construction comprises an outer upstanding wall panel hingedly connected to an edge of base portion, the outer upstanding wall panel is hingedly connected to a spacer panel, which spacer panel is hingedly connected to an inner upstanding wall panel, inner upstanding wall panel is hingedly connected to a locking panel, extending from each end of inner upstanding wall panel for two opposed outer layer side wall constructions are flaps respectively hingedly connected to inner upstanding wall panel;

between each of the outer layer side wall constructions, between the respective outer upstanding wall panel, is a web, respectively, each web comprises a first web panel hingedly connected to outer upstanding wall panel and a second web panel hingedly connected to the corresponding outer upstanding wall panel on the outer layer side wall construction, the first and second web panels being hingedly connected to each other by a crease line extending at approximately 45° from the ends of the outer upstanding wall panels to which it is attached;

wherein inner upstanding wall panel includes tabs cut from flaps respectively;

and at least one side wall about the inner layer side wall.

5. A carton as claimed in claim 4, wherein the two layers forming the inner side wall are in face to face contact.

6. A carton as claimed in claim 4 or claim 5, wherein the carton is adhesive-free.

7. A carton comprising an inner layer and an outer layer, the inner layer comprises:

a rectangular base portion from opposed edges of which extend a first inner layer side wall construction and a second inner layer side wall construction both hingedly connected to the base portion, the first inner layer side wall construction comprising a first wall hingedly connected to the base portion and oppositely to a second wall, the first wall having flaps extending from and hingedly connected at either end thereof with locking slots between the flaps and the first wall, the second wall having flaps extending from and hingedly connected at either end thereof with a V-shaped cut-out portion between the flaps and the second wall; the second inner layer wall construction being similar and configured to form walls mating along the free edges of the base portion;

the first inner layer side wall construction including T-shaped portions at the end of the flaps extending from the first and second walls, and the inner layer side wall construction including corresponding T-shaped slots at the end of the flaps extending from the first and second walls for interlocking with each other;

and the outer layer comprises a base portion and four outer layer side wall constructions, respectively, each outer layer side wall construction comprises an outer upstanding wall panel hingedly connected to an edge of base portion, the outer upstanding wall panel is hingedly connected to a spacer panel, which spacer panel is hingedly connected to an inner upstanding wall panel, inner upstanding wall panel is hingedly connected to a locking panel, extending from each end of inner upstanding wall panel for two opposed outer layer side wall constructions are flaps respectively hingedly connected to inner upstanding wall panel;

between each of the outer layer side wall constructions, between the respective outer upstanding wall panel, is a web, respectively, each web comprises a first web panel hingedly connected to outer upstanding wall panel and a second web panel hingedly connected to the corresponding outer upstanding wall panel on the outer layer side wall construction, the first and second web panels being hingedly connected to each other by a crease line extending at approximately 45° from the ends of the outer upstanding wall panels to which it is attached;

wherein inner upstanding wall panel includes tabs cut from flaps respectively;

and at least one side wall about the inner layer side wall.

8. A carton as claimed in claim 7, wherein the two layers forming the inner side wall are in face to face contact.

9. A carton as claimed in claim 7 or claim 8, wherein the carton is adhesive-free.

* * * * *